US005584189A

United States Patent [19]

Bustos

[11] Patent Number: 5,584,189

[45] Date of Patent: Dec. 17, 1996

[54] REFRIGERATED MERCHANDISER

[75] Inventor: Rafael T. Bustos, Alpharetta, Ga.

[73] Assignee: L&P Property Management Company, Chicago, Ill.

[21] Appl. No.: 433,812

[22] Filed: May 3, 1995

[51] Int. Cl.[6] ..... A47F 3/04

[52] U.S. Cl. ..... 62/255; 62/264

[58] Field of Search ..... 62/255, 264, 249; 362/125; 293/128

[56] References Cited

U.S. PATENT DOCUMENTS

| | | | |
|---|---|---|---|
| D. 130,995 | 1/1942 | Mayer . | |
| 470,022 | 3/1892 | Tuthill | 312/305 |
| 1,883,961 | 10/1932 | Kosmerl | 62/297 |
| 1,941,906 | 1/1934 | Marinsky | 211/151 |
| 2,066,865 | 1/1937 | Warner | 312/183 |
| 2,168,007 | 8/1939 | Swanson | 62/255 |
| 2,217,810 | 10/1940 | Pape | 312/183 |
| 2,499,088 | 2/1950 | Brill et al. | 62/255 |
| 3,010,290 | 11/1961 | Fredrick | 62/251 |
| 3,115,019 | 12/1963 | Rutishauser | 62/256 |
| 3,366,432 | 1/1968 | Carmer | 312/236 |
| 3,712,078 | 1/1973 | Maynard et al. | 62/448 |
| 3,999,475 | 12/1976 | Roderick | 99/474 |
| 4,089,322 | 5/1978 | Guibert | 126/261 |
| 4,416,122 | 11/1983 | Johnson | 62/448 |
| 4,828,302 | 5/1989 | Marasigan, Jr. | 293/128 |
| 5,072,343 | 12/1991 | Buers | 362/125 |
| 5,277,486 | 1/1994 | Bustos | 312/125 |

*Primary Examiner*—William E. Tapolcai

*Attorney, Agent, or Firm*—Wood, Herron & Evans, P.L.L.

[57] ABSTRACT

A multisided refrigerated display cabinet preferably being hexagonal in cross section and at least one door for accessing the interior product compartment from one side. Rotatable or non-rotatable shelves are provided within the display compartment. Three alternating insulated walls each include a recessed air duct leading from a refrigeration unit within a base of the display cabinet upwardly into the product compartment and opening to the product compartment. Three lights are mounted within the walls of the cabinet at locations substantially equally space about the periphery of the product compartment. Each major outer surface of the display cabinet also includes an adjustable bumper pad for protecting that surface from the impact of shopping carts and the like.

21 Claims, 5 Drawing Sheets

REFRIGERATED MERCHANDISER

BACKGROUND OF THE INVENTION

The present invention generally relates to product display cabinets and, more particularly, to a multisided refrigerated display cabinet.

Various product display cabinets, including multisided refrigerated cabinets have been proposed in the past for allowing food products to be displayed and readily accessed by the customer. Many refrigerated display units include air ducts within the product compartment for distributing cooled air from the refrigeration unit associated with the display throughout the product display compartment of the cabinet. While these air ducts will generally fulfill the objective of distributing air in an even manner, they also take up valuable product space within the compartment or require that the display cabinet be made larger to account for the space taken up by the air ducts.

Refrigerated display cabinets also generally include some type of lighting for the product compartment. Conventionally, fluorescent lighting is mounted within the product display compartment. As this lighting necessarily generates heat within the compartment which is being cooled by the refrigeration unit, the refrigeration efficiency of the display is reduced. That is, the refrigeration unit must work harder to counteract the heat produced by the lighting. One manner to attack this problem is to use less lighting or lower wattage lights in the product display compartment. This is undesirable, however, as the product in the compartment will be less visible and consumers will be generally less attracted to the display.

As refrigerated displays are being increasingly used in the high traffic check-out areas of grocery stores, for example, it has become important to maintain their pleasing appearance and, therefore, their attraction to the consumer. One of the main ways that these check-out displays become marred and unattractive is by repeated impact with the shopping carts of customers. Often, the displays do not have adequate bumper pads or do not have bumper pads disposed at the correct impact height or location for every size and style of shopping cart.

It therefore would be desirable to provide a product display cabinet, especially a refrigerated display cabinet, which addresses these and other problems in the art and presents a more space and energy efficient cabinet as well as a cabinet which is more attractive to the consumer over a longer period of time.

SUMMARY OF THE INVENTION

One objective of the present invention therefore has been to provide a refrigerated product display cabinet which has both an energy efficient and space efficient structure.

Another more specific objective of the invention has been to provide a refrigerated cabinet which includes a well lit product compartment, but which also minimizes heating of the product compartment caused by the cabinet lighting.

Still another objective of the invention has been to provide a cabinet having an attractive appearance which is easily protected from the impact of shopping carts of varying sizes and styles.

To these ends, a preferred embodiment of the present invention is constructed as a multisided refrigerated display cabinet having a number of advantageous features. The cabinet structure is preferably six-sided or hexagonal in cross section and at least one side includes a door for accessing the interior product display compartment. In one preferred embodiment, hexagonal shelves are provided to match the cross sectional shape of the product compartment. In this embodiment, every other side of the six-sided cabinet includes a door such that all sides of each shelf may be accessed through three doors spaced about the display cabinet. The remaining three sides of the display cabinet comprise insulated walls. In a second embodiment, rotatable circular shelves are mounted within the display cabinet and only one of the six sides includes a door for accessing the product compartment. In this embodiment, the remaining five sides of the display cabinet comprise insulated walls.

In accordance with one aspect of each embodiment of the invention, at least one cool air duct is recessed into an insulated wall of the display cabinet. Most preferably, three alternating insulated walls each include a recessed air duct leading from a refrigeration unit within a base of the display cabinet upwardly into the product compartment and opening to the product compartment. These air ducts preferably comprise vertically extending space saving recesses formed in the insulated walls and covered by a louvered or slotted cover plate. This unique design allows product to be accessed about the entire periphery of the cabinet through equally spaced apart doors and also allows the product compartment to be evenly cooled through ducts also equally spaced about the periphery of the product compartment.

Another aspect of each embodiment of this invention involves the mounting of lights to the cabinet for lighting the interior product compartment. Preferably, three lights are recessed within the side wall structure of the cabinet at locations substantially equally spaced about the periphery of the product display compartment but outside the display compartment. Specifically, elongate fluorescent lights are mounted vertically within pillars disposed between adjacent sides of the display cabinet. The lights are fully contained within the pillars and extend along substantially the entire height of the product display compartment. A transparent, or at least translucent, cover is provided on the side of the pillar facing the product display compartment.

Major outer surfaces of the display cabinet also preferably includes an adjustable bumper pad for protecting that surface from the impact of shopping carts and the like. The pads are mounted to a respective outer surface, such as a door or an insulated wall, in a manner which allows them to be moved to the location which defines an impact point for a particular cart being used at the location of the display. In the preferred embodiments, the entire periphery of the six-sided display cabinet is protected by six bumper pads, one pad being affixed to each side. The pads may be adjusted vertically and then fixed in place at the desired location on the door or wall. In the preferred embodiments, bumper pads which are used on the doors of the unit also have handle structure used for opening and closing the doors. This handle structure is preferably a recessed handle formed in the pad.

Additional objects and advantages of the present invention will become more readily apparent upon review of the following detailed description taken in conjunction with the accompanying drawings.

DETAILED DESCRIPTION OF THE PREFERRED EMBODIMENTS

Figure 1:
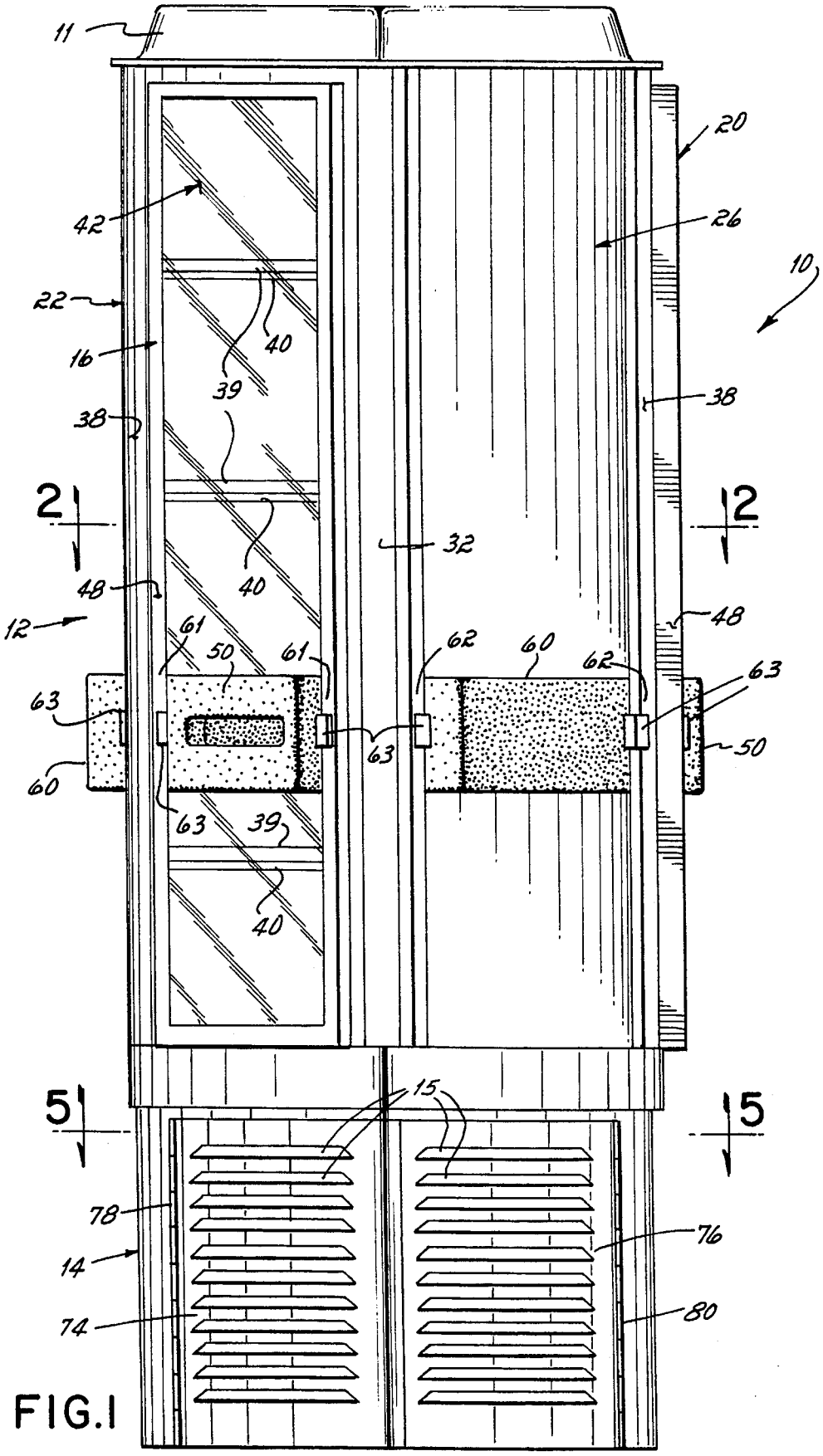
FIG. 1. is a side elevational view of a refrigerated display cabinet constructed in accordance with a preferred embodiment of this invention.
Figure 2:
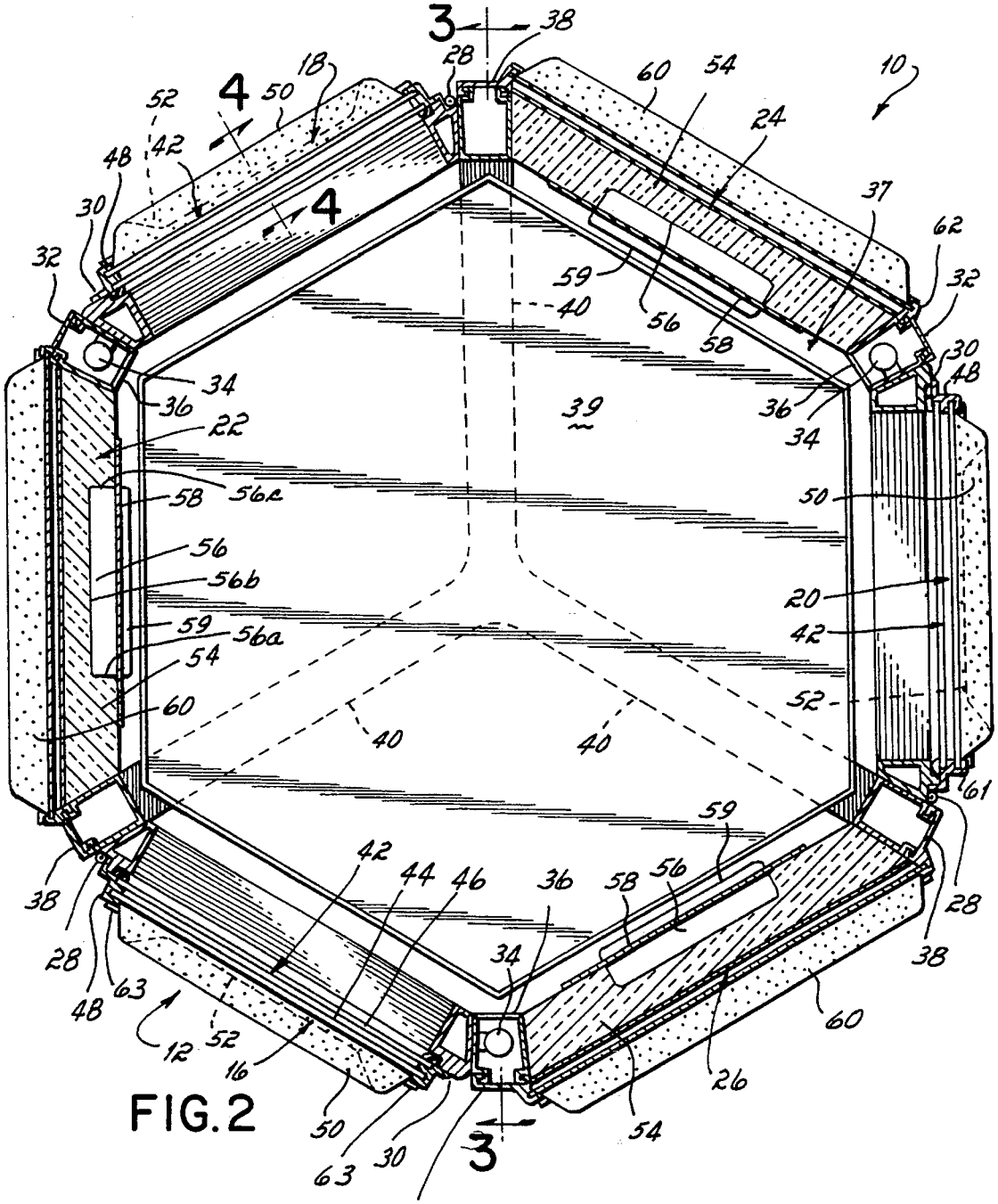
FIG. 2 is a cross sectional view taken along line 2—2 of FIG. 1.

Referring generally to FIGS. 1 and 2, a merchandising display cabinet 10 constructed in accordance with the invention is shown and includes a top 11, a base 14 and an intermediate product carrying and display section 12. As illustrated by FIG. 2, cabinet 10 is six-sided or hexagonal in cross section. In this first embodiment, three sides have hinged doors 16, 18, 20 mounted therein, while the three remaining sides comprise insulated walls 22, 24, 26. Each door 16, 18, 20 includes a hinged longitudinal edge 28 and an openable sealing edge 30 which seals against one of three adjacent vertical pillars 32 when the respective door 16, 18 or 20 is closed.

Figure 3:
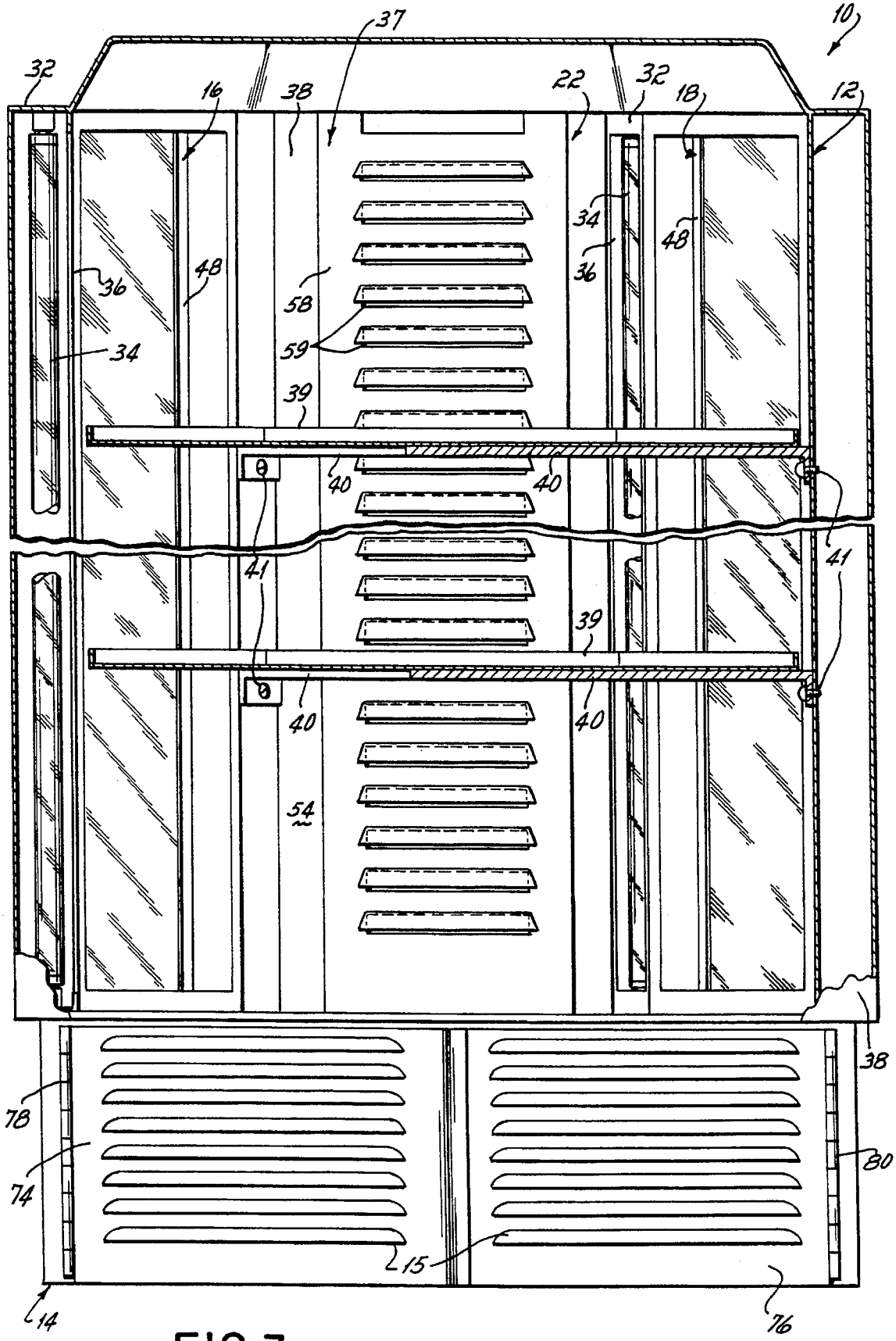
FIG. 3 is a partially fragmented cross sectional view of the cabinet taken along line 3—3 of FIG. 2 but having the base rotated 90 degrees to simplify the description thereof.

As further shown in FIGS. 2 and 3, fluorescent lights 34 are mounted vertically within pillars 32 along the open edge 30 of each door 16, 18, 20 and thereby incorporated into the walls of the cabinet 10. Clear or translucent panels 36 are provided on the inner side of pillars 32 to allow light to be directed into product display compartment 37 of cabinet 10. As will be appreciated from a review of FIG. 2, the incorporation of lights 34 into the walls of cabinet 10 and outside of product display compartment 37 increases shelf space and also lowers the amount of heat which would otherwise be generated within product display compartment were lights 34 to be mounted directly therein. Vertical support pillars 38 are also provided along the opposite edges of doors 16, 18, 20 on which to mount hinges 28. From FIG. 2, it will be appreciated that doors 16, 18 and 20, insulated walls 22, 24 and 26, and pillars 32, 38 generally comprise the side wall structure of cabinet 10. Hexagonally shaped shelves 39 are supported on shelf supports 40 mounted to pillars 38. As shown in FIG. 3, shelf supports 40 are fixed to pillars 38 by screw fasteners 41.

Figure 4:
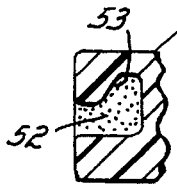
FIG. 4 is a cross sectional view of the door handle structure taken along line 4—4 of FIG. 2.

As mentioned above, and referring now specifically to FIG. 2, the six sides of cabinet 10 are preferably comprised of three doors 16, 18, 20 alternating with three insulated walls 22, 24, 26. Each door 16, 18, 20 preferably includes a thermoglass panel 42 comprised of two panes of glass 44, 46 in a conventional manner. Thermoglass panel 42 is surrounded and mounted within a frame structure 48. Bumper pads 50 are provided on doors 16, 18, 20 for protecting doors 16, 18, 20 and, more specifically, thermoglass panels 42 from impact by shopping carts and the like. As best shown in FIG. 4, each bumper pad 50 also includes a handle 52 for allowing the respective door 16, 18, 20 to be opened and closed. Preferably, this handle structure comprises an undercut portion 53 of bumper pad 50 which may be grasped and pulled by a person desiring access to product compartment 37.

Still referring to FIGS. 2 and 3, each insulated wall 22, 24, 26 comprises a solid insulation panel 54 formed from conventional solid heat insulating material, such as polystyrene or polyurethane foam, and mounted between pillars 32, 38. Each of the three insulation panels 54 includes a built in air duct 56 in the form of a vertically extending recess of each panel 54 opening to product display compartment 37. Each air duct 56 is covered by a vented panel 58 which includes vertically spaced openings or grates 59 for allowing cool air from a refrigeration unit 68 within base 14 (FIG. 5) to be distributed throughout product compartment 37. As air ducts 56 are built in or recessed within insulation panels 54, three of sides 56*a*, 56*b*, 56*c* of each duct 56 are advantageously insulated and, at the same time, product space within compartment 37 is maximized since separate air ducts within compartment 37 are not necessary. Finally, like doors 16, 18, 20, insulated walls 22, 24, 26 include bumper pads 60 for absorbing impact from shopping carts and the like. Pads 50 and 60 may each be formed from suitable rigid polymeric foam, such as polyurethane foam, by conventional molding techniques.

Figure 2A:
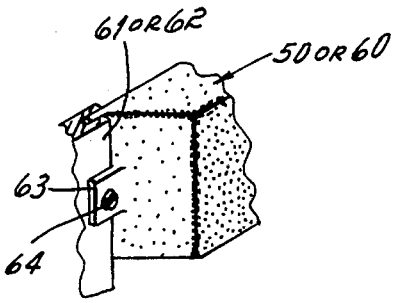
FIG. 2A is a fragmentary perspective view of a typical adjustable bumper pad mount.

As best shown in FIG. 1, 2 and 2A, bumper pads 50 and 60 of doors 16, 18, 20 and insulated walls 22, 24, 26 are each height adjustable so that they may be adjusted, for example, to the impact height of the particular shopping carts used at a given location. Many different manners of mounting pads 50 and 60 in a height adjustable fashion may be chosen. In the preferred embodiment, pads 50 and 60 are mounted for vertical sliding movement along flanges 61 on door frame 48 or flanges 62 on pillars 32 and 38. Pads 50 and 60 include respective side mounting tabs 63 having set screws 64 for allowing pads 50 and 60 to be fixed in place once they have been adjusted to the desired height.

Figure 5:
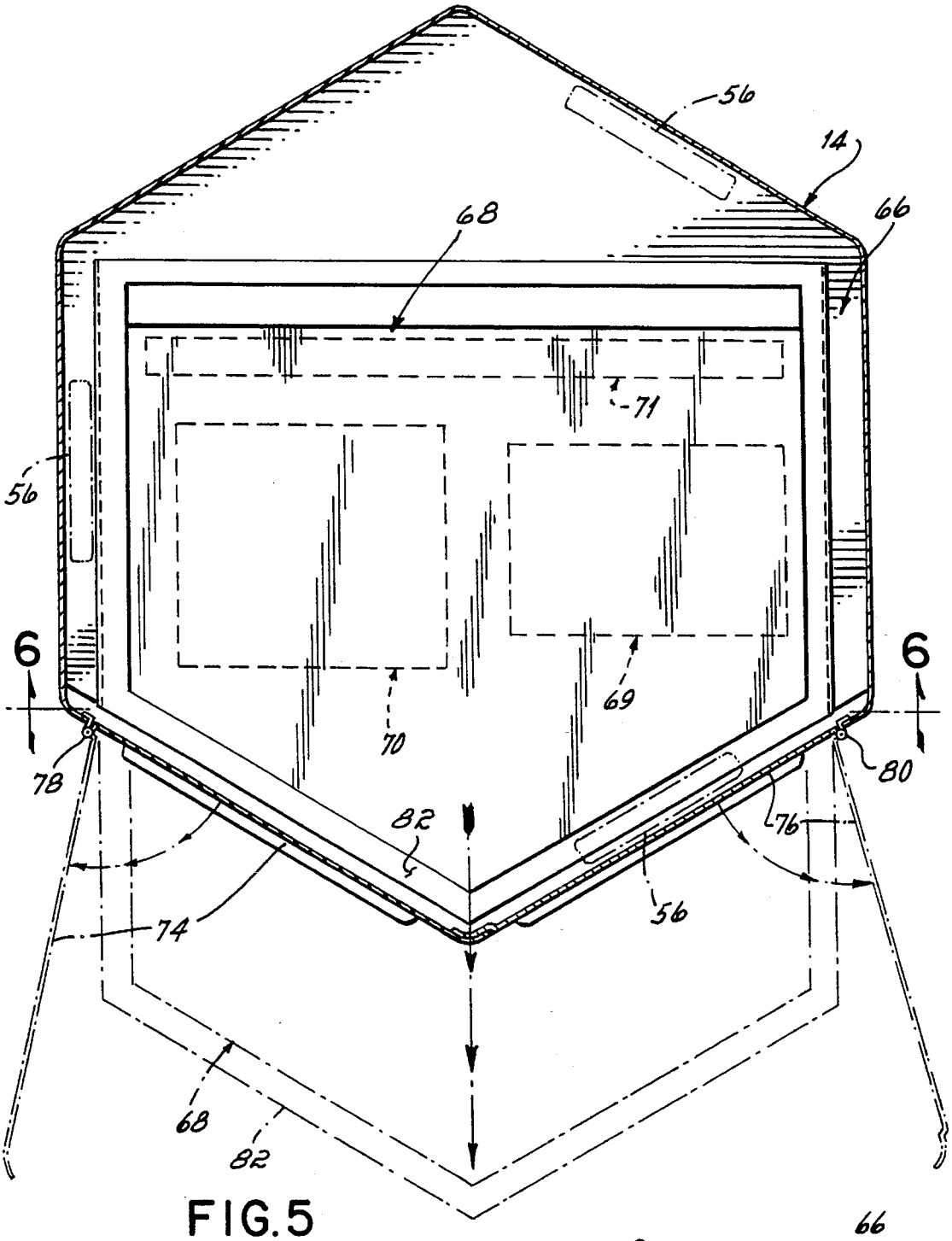
FIG. 5 is a cross sectional view taken along line 5—5 of FIG. 1 showing the refrigeration unit compartment within the base of the cabinet and a refrigeration unit being schematically shown.
Figure 6:
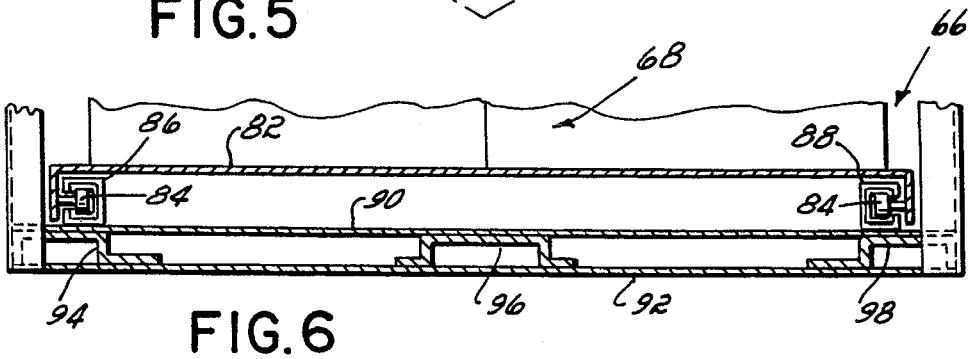
FIG. 6 is a cross sectional view taken along line 6—6 of FIG. 5.

Referring now to FIG. 5, base 14 of cabinet 10 includes a compartment 66 for holding a refrigeration unit 68. Refrigeration unit 68 is comprised of conventional refrigeration components including a compressor 69, a condenser 70 and an evaporator 71. Detailed description of the operation and connections between these various conventional components is not deemed necessary, as such is well known to those of ordinary skill in the art. Compartment 66 may be accessed through a pair of doors 74, 76 hinged along respective edges 78, 80. A tray 82 is mounted for sliding movement past doors 74, 76 such that refrigeration unit 68 mounted thereon may be conveniently accessed for maintenance purposes. As more specifically illustrated in FIG. 6, tray 82 is supported on rollers 84 held within a pair of rails 86, 88 mounted on a lower panel 90. Panel 90 is supported above floor 92 of cabinet base 14 by a plurality of support members 94, 96, 98.

Figure 7:
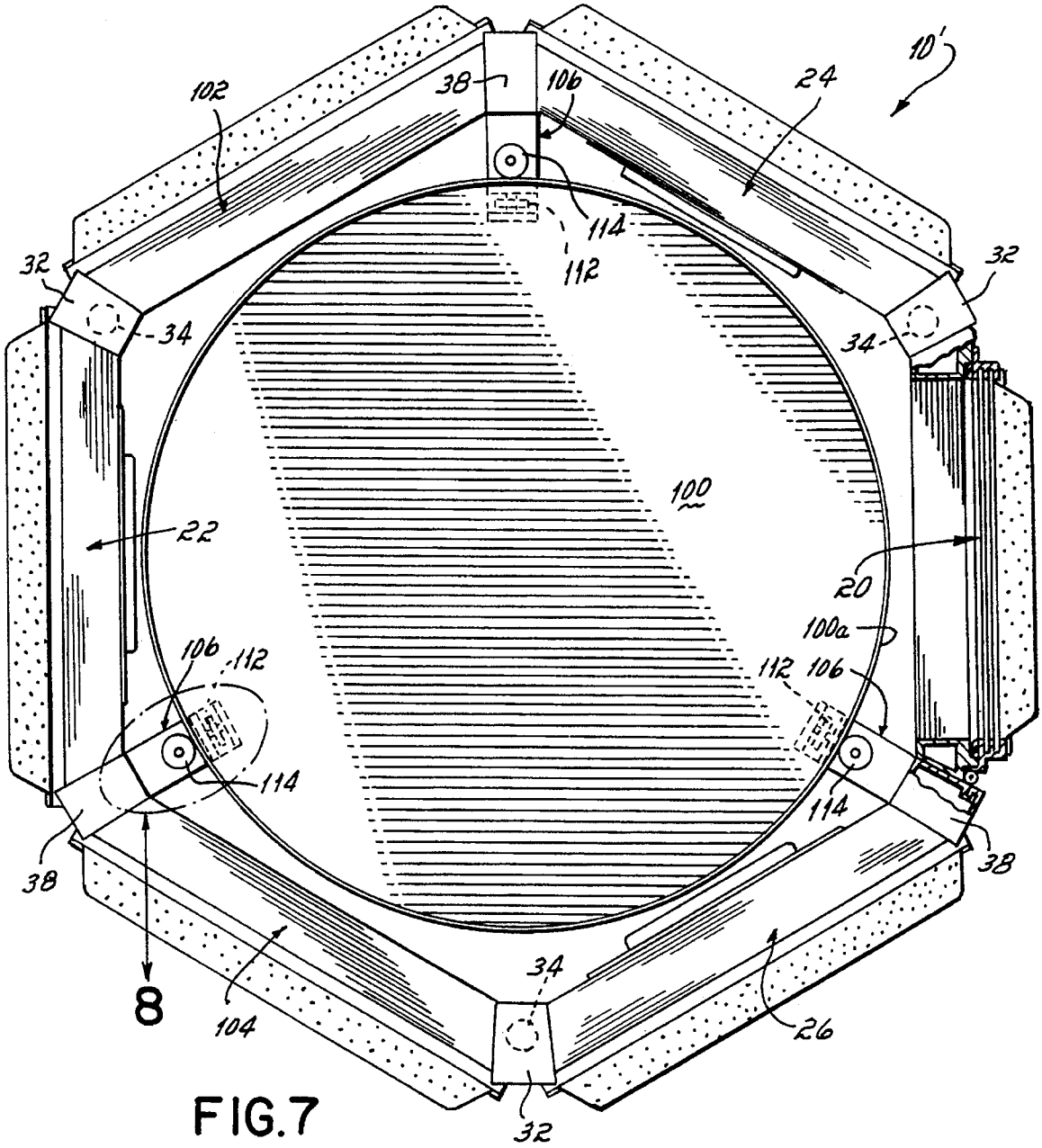
FIG. 7 is a partially fragmented top view of an alternative embodiment of the cabinet with the top of the cabinet removed.

FIG. 7 illustrates a refrigerated display cabinet 10' constructed in accordance with an alternative embodiment of the present invention. It should be noted that like numerals in the drawings of the two embodiments represent like structure. There are only two main differences between cabinet 10 of the first embodiment and cabinet 10' of this second embodiment. First, two doors have been eliminated and, second, rotatable circular shelves 100 (only one of which is shown in FIG. 7) have been substituted for the non-rotatable hexagonal shelves 39 of the first embodiment.

Figure 8:
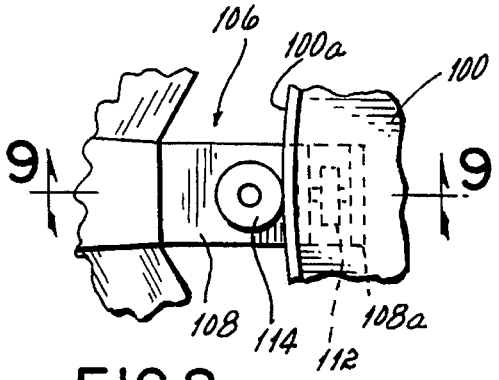
FIG. 8 is an enlarged view of encircled portion "8" taken from FIG. 7.
Figure 9:
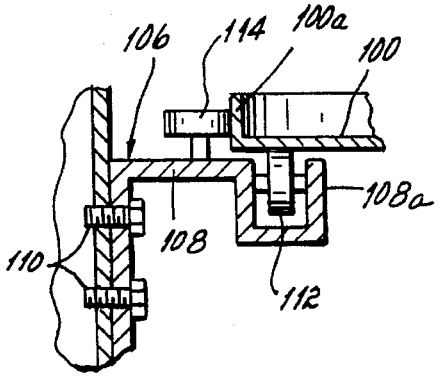
FIG. 9 is a cross sectional view taken along line 9—9 of FIG. 8.

These differences may be fully appreciated from FIGS. 7–9 without again illustrating the entire cabinet structure.

Specifically, cabinet 10' is six-sided or hexagonal in cross section just as cabinet 10 of the first embodiment, and while including the three insulated walls 22, 24, 26 of the first embodiment, replaces two of the three doors with insulated walls 102, 104, leaving only one door 20. The structure of insulated walls 22, 24, 26, 102, 104 as well as the structure of door 20 is the same as the corresponding structure associated with cabinet 10 of the first embodiment and therefore need not be described further here.

As briefly mentioned above rotatable shelves 100 are provided such that consumers may access product on any portion of a particular shelf 100 through only the single door 20. As shown in FIG. 7 and detailed more particularly in FIGS. 8 and 9, three roller supports 106 are rigidly secured to respective pillars 38 and support one shelf 100 for rotation within product compartment 37. Each roller support specifically comprises a bracket 108 secured to a pillar 38 by screw fasteners 110. A horizontally oriented roller 112 is affixed for rotation to the top of bracket 108, while an outer end **108*a* of bracket 108 carries a vertically oriented roller 114. Roller 112 bears and rotates against an outer periphery 100*a* of shelf 100 and roller 114 supports the bottom of shelf 100** during rotation.

From the foregoing, it will be appreciated that a merchandiser display constructed in accordance with the present invention provides increased interior product space without increasing the exterior size of the display. The display also efficiently cools the product compartment by way of the uniquely placed and incorporated cooling vents. Finally, the unique placement of lighting insures good product visibility and minimizes transfer of heat into the product compartment by the lighting. As a result, less energy is expended by the refrigeration unit of the display to maintain the product compartment at a given refrigeration temperature.

Although a detailed description of the preferred embodiments has been given, it is not Applicant's intention to be bound by such details since many modifications within the spirit and scope of the invention will be readily appreciated by persons in this field. Applicant's intent is therefore to be bound only by the legal scope of the claims appended hereto.

What is claimed is:

1. A refrigerated merchandising display comprising:

a housing including an enclosed product display compartment bounded by a top, a base and a surrounding side wall structure including a plurality of sides extending between said top and said base, said sides respectively including a plurality of insulated side walls separated by respective doors for accessing said product display compartment;

a plurality of product display shelves mounted within said product display compartment;

a refrigeration unit operatively connected to said housing for cooling said product display compartment; and, a plurality of cool air ducts leading from said refrigeration unit to said product display compartment, said cool air ducts each comprising a recess in one of said insulated side walls opening to said product display compartment.

2. The refrigerated merchandising display of claim 1 wherein said housing is six-sided and includes three doors with one door being mounted in every other side of said housing and the three remaining sides being insulated side walls.

3. The refrigerated merchandising display of claim 2 further comprising three of said cool air ducts with one cool air duct being located within each insulated side wall.

4. The refrigerated merchandising display of claim 3 wherein each cool air duct comprises an elongate vertical recess having an open side facing said product display compartment and three sides defined by an insulated wall containing the recess.

5. The refrigerated merchandising display of claim 1 wherein said at least one cool air duct comprises an elongate vertical recess having an open side facing said product display compartment and three sides defined by said one insulated wall.

6. The refrigerated merchandising display of claim 1 further comprising a plurality of lights recessed within the side wall structure of said housing for lighting said product display compartment.

7. The refrigerated merchandising display of claim 6 wherein said lights are mounted within pillars located between adjacent sides of said side wall structure.

8. The refrigerated merchandising display of claim 6 wherein each light further comprises an elongate fluorescent light extending between upper and lower ends of said product display compartment.

9. The refrigerated merchandising display of claim 7 wherein said pillars include a cover mounted along an inner side thereof facing said product display compartment and allowing light to be directed therethrough into said product display compartment.

10. The refrigerated merchandising display of claim 1 further comprising a plurality of bumper pads mounted for adjustable movement on outside surfaces of said sides.

11. The refrigerated merchandising display of claim 10 further comprising a bumper pad on said door, wherein the bumper pad on said door includes handle structure for opening and closing said door.

12. The refrigerated merchandising display of claim 11 wherein said handle structure comprises a recessed portion of the bumper pad on said door.

13. A refrigerated merchandising display comprising:

a housing including an enclosed product display compartment bounded by a top, a base and a surrounding side wall structure including six sides extending between said top and said base and pillars disposed between adjacent sides, said sides including three insulated side walls separated by three respective doors for accessing said product display compartment, each of said being hinged along a first vertical edge and openable along a second vertical edge;

a plurality of product display shelves mounted within said product display compartment;

a refrigeration unit operatively connected to said housing for cooling said product display compartment; and, a plurality of lights substantially equally spaced about a periphery of said product display compartment, said lights being recessed within every other pillar of said housing outside said product display compartment and extending between upper and lower portions of said product display compartment along the second vertical edges of said doors.

14. The refrigerated merchandising display of claim 13 wherein each light further comprises an elongate fluorescent light extending between upper and lower ends of said product display compartment.

15. The refrigerated merchandising display of claim 13 wherein said pillars include a cover mounted along an inner side thereof facing said product display compartment and allowing light to be directed therethrough into said product display compartment.

16. The refrigerated merchandising display of claim 13 further comprising a plurality of bumper pads mounted for adjustable movement on outside surfaces of said sides.

17. The refrigerated merchandising display of claim 16 further comprising a bumper pad on said door, wherein the bumper pad on said door includes handle structure for opening and closing said door.

18. The refrigerated merchandising display of claim 17 wherein said handle structure comprises a recessed portion of the bumper pad on said door.

19. A refrigerated merchandising display comprising:

a housing including an enclosed product display compartment having a top, a base and a surrounding side wall structure including plurality of sides extending between said top and said base, said sides including a plurality of insulated side walls and at least one side including a door for accessing said product display compartment;

a plurality of product display shelves mounted within said product display compartment;

a refrigeration unit operatively connected to said housing for cooling said product display compartment; and, a plurality of bumper pads mounted for adjustable movement on outside surfaces of said sides, one of said bumper pads being mounted on said door and including handle structure for opening and closing said door.

20. The refrigerated merchandising display of claim 19 wherein said handle structure comprises a recessed portion of the bumper pad on said door.

21. A refrigerated merchandising display comprising:

a housing including an enclosed product display compartment having a top, a base and a side wall structure including a plurality of sides extending between said top and said base, said sides including a plurality of insulated side walls and at least one side including a door for accessing said product display compartment;

a plurality of product display shelves mounted within said product display compartment;

a refrigeration unit operatively connected to said housing for cooling said product display compartment;

at least one cool air duct leading from said refrigeration unit to said product display compartment, said cool air duct comprising a recess in one of said insulated side walls opening to said product display compartment;

a plurality of bumper pads mounted for adjustable movement on outside surfaces of said sides; and, a plurality of lights substantially equally spaced about a periphery of said product display compartment, said lights being recessed within said side wall structure of said housing outside of said product display compartment and extending between upper and lower portions of said product display compartment.

* * * * *

UNITED STATES PATENT AND TRADEMARK OFFICE

CERTIFICATE OF CORRECTION

PATENT NO. : 5,584,189

DATED : December 17, 1996

INVENTOR(S) : Rafael T. Bustos

It is certified that error appears in the above-indentified patent and that said Letters Patent is hereby corrected as shown below:

In column 6, line 47, after "each of said", insert ---doors---.

Signed and Sealed this

Twenty-seventh Day of May, 1997

*Attest:*

Bruce Lehman

BRUCE LEHMAN

*Attesting Officer*

*Commissioner of Patents and Trademarks*